US005193512A

United States Patent [19]

Steinbrenner et al.

[11] Patent Number: 5,193,512

[45] Date of Patent: Mar. 16, 1993

[54] TANK-VENTING SYSTEM FOR A MOTOR VEHICLE AND METHOD FOR CHECKING THE OPERABILITY THEREOF

[75] Inventors: Ulrich Steinbrenner; Helmut Denz, both of Stuttgart; Ernst Wild, Oberriexingen; Wolfgang Wagner, Korntal-Münchingen, all of Fed. Rep. of Germany

[73] Assignee: Robert Bosch GmbH, Stuttgart, Fed. Rep. of Germany

[21] Appl. No.: 768,973

[22] PCT Filed: Jan. 9, 1991

[86] PCT No.: PCT/DE91/00010

§ 371 Date: Oct. 8, 1991

§ 102(e) Date: Oct. 8, 1991

[87] PCT Pub. No.: WO91/12426

PCT Pub. Date: Aug. 22, 1991

[30] Foreign Application Priority Data

Feb. 8, 1990 [DE] Fed. Rep. of Germany ..... 4003751

[51] Int. Cl.[5] ..... F02M 33/02

[52] U.S. Cl. ..... 123/520; 123/198 D; 123/519

[58] Field of Search ..... 123/516, 518, 519, 520, 123/521, 479, 198 D, 494; 73/117.3, 118.1, 40.1

[56] References Cited

U.S. PATENT DOCUMENTS

| | | | |
|---|---|---|---|
| 4,173,207 | 11/1979 | Hiramatsu | 123/519 |
| 4,338,106 | 7/1982 | Mizuno et al. | 123/519 |
| 4,430,099 | 2/1984 | Yanagisawa et al. | 123/519 |
| 4,646,702 | 3/1987 | Matsubara | 123/520 |
| 4,702,216 | 10/1987 | Huruta et al. | 123/519 |
| 4,817,576 | 4/1989 | Abe et al. | 123/518 |
| 4,862,856 | 9/1989 | Yokoe et al. | 123/519 |
| 4,872,439 | 10/1989 | Sonoda et al. | 123/516 |
| 4,949,695 | 8/1990 | Uranishi et al. | 123/494 |
| 4,953,514 | 9/1990 | Beicht et al. | 123/520 |
| 5,021,071 | 6/1991 | Reddy | 123/518 |
| 5,085,197 | 2/1992 | Mader et al. | 123/520 |

FOREIGN PATENT DOCUMENTS

| | | | |
|---|---|---|---|
| 0055226 | 5/1979 | Japan | 123/520 |
| 0000544 | 1/1981 | Japan | 123/519 |
| 0060423 | 3/1989 | Japan | 123/519 |

*Primary Examiner*—E. Rollins Cross
*Assistant Examiner*—Thomas Moulis
*Attorney, Agent, or Firm*—Walter Ottesen

[57] ABSTRACT

A tank-venting system has an adsorption filter (AF) with a venting line (BL) which can be shut off by means of a controllable shut-off valve (AV). The shut-off venting valve makes it possible to set underpressures and overpressures in the system in a concerted manner in order to check its operability. As a result, particularly reliable information relating to the operability can be obtained.

5 Claims, 2 Drawing Sheets

TANK-VENTING SYSTEM FOR A MOTOR VEHICLE AND METHOD FOR CHECKING THE OPERABILITY THEREOF

FIELD OF THE INVENTION

The invention relates to a tank-venting system for a motor vehicle and methods for checking the operability of such a system.

BACKGROUND OF THE INVENTION

A tank-venting system generally has a fuel tank and a tank-venting valve which is connected to the intake pipe of an internal combustion engine so that fuel vapors can be evacuated by suction with the aid of the underpressure in the intake pipe. Usually, the volume located above the fuel in the tank is not directly evacuated by suction; rather, an adsorption filter, usually an activated carbon filter, is connected between the tank and the tank-venting valve. This activated carbon filter adsorbs fuel in those periods in which no drawing out by suction via the intake pipe occurs, for example when the internal combustion engine is at standstill or when the tank-venting valve is kept closed due to the current operating state.

There is a risk of tank-venting systems developing leaks or the tank-venting valve not operating correctly. The operability of systems of this kind is therefore to be checked repeatedly during the operation of a motor vehicle.

The most important method for checking the operability of a motor vehicle tank-venting system is based on a proposal of the California Environmental Authority CARB. According to this method, when opening the tank-venting valve, a check is made as to whether a lambda controller has to carry out a correction of its control output. This is always the case when air with fuel vapor is evacuated by suction of the tank-venting system. However, it is also the case that the adsorption filter can be completely regenerated and that the fuel in the tank is completely evaporated. When the tank-venting valve is opened, no fuel is supplied in addition to that which is supplied to the injection valves of the internal combustion engine according to the control output of the lambda control. In such a case in which therefore no fuel is supplied by the tank-venting system, that is, the lambda controller does not have to carry out a correction, it is unclear whether the tank-venting system has developed a leak or whether no fuel is being supplied because of the mentioned reasons. In order to be able to decide this question, according to the known method, an evaluation of the signal from the lambda controller only occurs when a fuel temperature sensor indicates that a predetermined minimum fuel temperature is exceeded and a tank level sensor indicates that the vehicle tank has been filled. It is assumed that fuel vapor would then have to be present in the system in any event which vapor is drawn in when the tank-venting valve is opened and which then leads to a correction of the lambda controller. However, with this method incorrect decisions repeatedly occur if there is in fact evaporated fuel in the tank, refilling occurs with the same kind of fuel and the adsorption filter is largely regenerated.

Accordingly, there was still the problem of specifying a method for checking the operability of a motor vehicle tank-venting system which emits as few unjustified fault reports as possible. In addition, there was the problem of specifying a tank-venting system whose operability can be checked in a particularly reliable manner.

SUMMARY OF THE INVENTION

The tank-venting system according to the invention for a motor vehicle has the following parts: a fuel tank; an adsorption filter which is connected to the fuel tank via a filter line and which has a venting line with a controllable shut-off valve; and, a tank-venting valve which connects the adsorption filter to the intake pipe of an internal combustion engine via a valve line.

The system is different from known systems in that the venting line of the adsorption filter can be shut off in a controlled manner. This permits the methods according to the invention specified below for the checking the operability of the system. The methods have the concept in common that they utilize the possibility of shutting off the venting line of the adsorption filter.

The method according to the invention for checking the operability of a motor vehicle tank-venting system operates in such a way that:

the venting line of the adsorption filter of the system is shut off;

the tank-venting valve of the system is opened;

and it is measured whether underpressure is building up in the tank and, if this is the case, it is concluded that the system is operative.

In order to be able to check not only the tightness of the system and the underpressure operability of different valves but the complete operability of all the valves, the additional advantageous procedure adopted is that:

the venting line of the adsorption filter of the system is shut off;

the tank-venting valve of the system is not opened until a minimum overpressure has built up in the tank and the internal combustion engine to which the system is connected is operating at low rates of airflow;

and it is checked whether a lambda control has to carry out a correction in the direction of leanness when the tank-venting valve is opened and, if this is the case, it is concluded that the system is operative.

The possibility of shutting off the venting line permits to set sufficiently large overpressures and underpressures for a particularly reliable checking of the operability of the system.

In order that excessively high pressures do not build up in the case of a fault of the shut-off element for the venting line, the shut-off element advantageously has overpressure and underpressure protection valves. The operability of the shut-off element can be checked in that the venting line is cleared again when underpressure is present. If the underpressure subsequently decays, this is an indication that the shut-off element is operating correctly.

DESCRIPTION OF THE PREFERRED EMBODIMENT OF THE INVENTION

Figure 1:
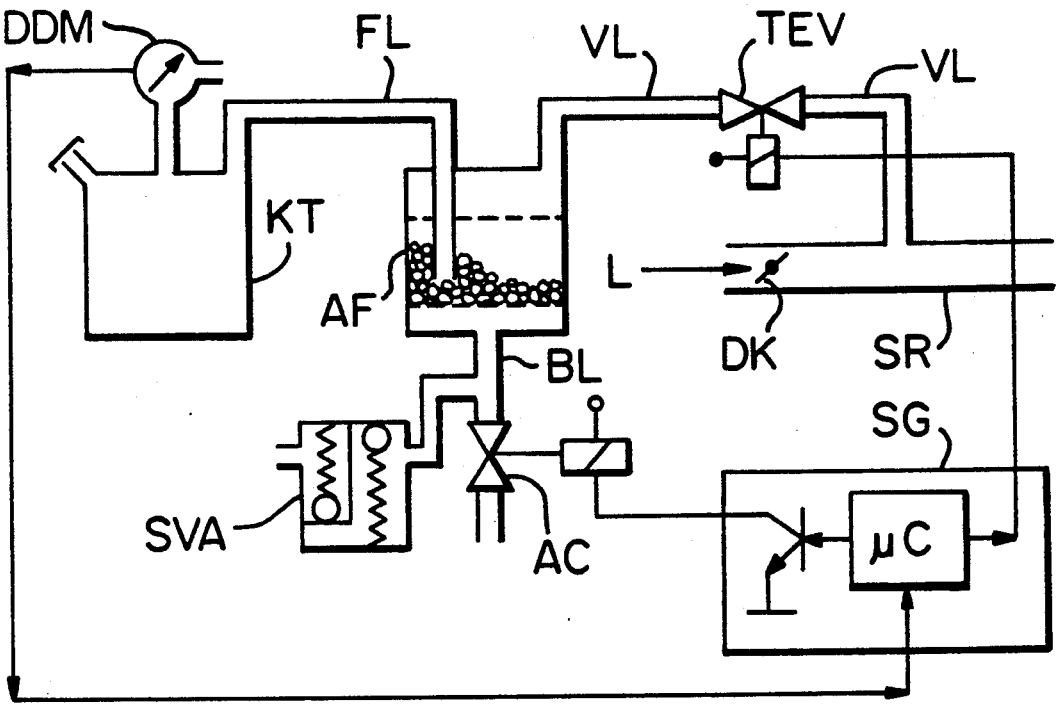
FIG. 1 shows a schematic illustration of a tank-venting system having an adsorption filter with a shut-off venting line.

FIG. 1 shows a schematic illustration of a tank-venting system having a fuel tank KT, an adsorption filter AF and a tank-venting valve TEV. The tank-venting valve TEV is located in a valve line VL which connects the adsorption filter AF to the intake pipe SR of an internal combustion engine (not shown). The valve line communicates behind the throttle flap in the flow direction L of air drawn in by suction. As a result, it is possible to achieve a relatively high underpressure in the valve line in order effectively to flush the adsorption filter AF. With a largely closed throttle flap and relatively high speeds of rotation, the underpressure falls to a few 100 hPa.

The adsorption filter AF is connected, in turn, to the fuel tank KT via a filter line FL. If the fuel in the fuel tank evaporates, the evaporating fuel is adsorbed by the activated carbon in the adsorption filter AF. Apart from the filter line FL and the valve line VL just mentioned, a venting line BL also opens into the adsorption filter AF. Air flows through this venting line BL when the adsorption filter AF is evacuated by suction via the valve line having the tank-venting valve TEV. As a result, the activated carbon is regenerated. In the standstill phases of the engine or in operating phases in which the tank-venting valve is closed, the activated carbon can then take up fuel again.

The tank-venting system shown in FIG. 1 has, by virtue of components which are still to be described, a design which can be checked for operability in a particularly reliable way. These additional components are a differential pressure sensor DDM which measures the differential pressure in the tank in relation to atmospheric pressure and a shut-off valve for controllably shutting off the venting line BL. The shut-off valve AV can be opened or closed using a signal which is emitted by a control unit SG. The criteria according to which signals are emitted will be explained below with reference to FIG. 3.

So that no excessively high or excessively low pressure can build up in the tank-venting system if the shut-off valve AV is not operating correctly, the line of a protective valve arrangement SVA also leads into the venting line BL with the protective valve arrangement having an overpressure and an underpressure protection valve. The pressures in the protective valve arrangement are set in such a way that no risk of damage to the tank-venting system arises due to excessively high or excessively low pressures.

Figure 2:
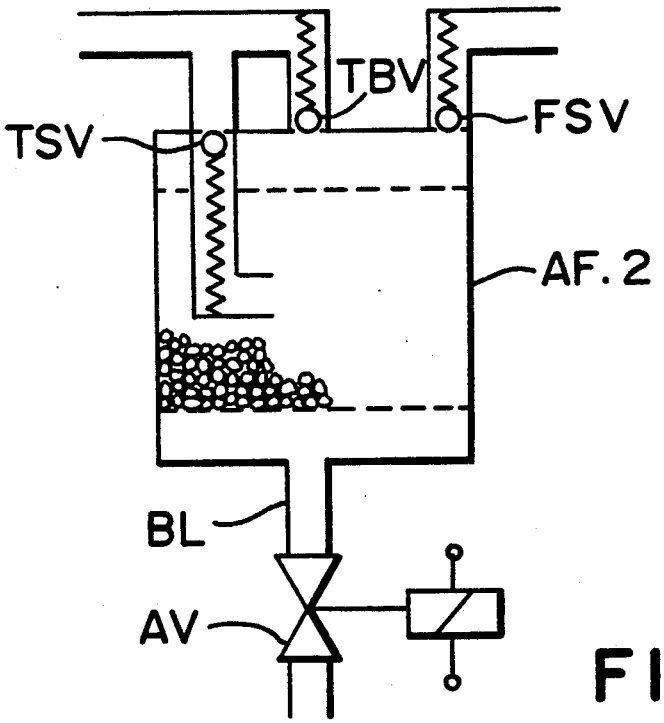
FIG. 2 shows a schematic illustration of a known adsorption filter with check valves for the purpose of explaining how the operability of the check valves of the filter can be checked; and, FIG. 3 shows a flow diagram for explaining a method for checking the operability of a motor vehicle tank-venting system which operates both with a check with underpressure as well as with such a check with overpressure.

FIG. 2 shows an adsorption filter AF.2 which is equipped with a check valve arrangement. A tank shut-off valve TSV ensures that fuel gas only passes into the adsorption filter AF when a specific overpressure is exceeded in the fuel tank KT, for example 30 hPa. Since this tank shut-off valve TSV prevents the venting of the tank in the case of underpressure, a tank-venting valve TBV is additionally present which, for example at an underpressure of 30 hPa, opens in the tank. In order to prevent fuel vapor evaporating out of the adsorption filter AF from evaporating into the intake pipe SR, which would be particularly disadvantageous for hot starts of an internal combustion engine, a filter shut-off valve FSV is provided which does not clear the path into the valve line VL until there is a drop below a specific underpressure in this line, for example in the case of a pressure to less than 50 hPa.

In the tank-venting system according to FIG. 1, various faults may occur. Thus, it is possible that all the components may develop leaks. Furthermore, the tank-venting valve TEV and the shut-off valve AB can become inoperative. In the adsorption filter AF.2 according to FIG. 2, the check valves may become inoperable.

Figure 3:
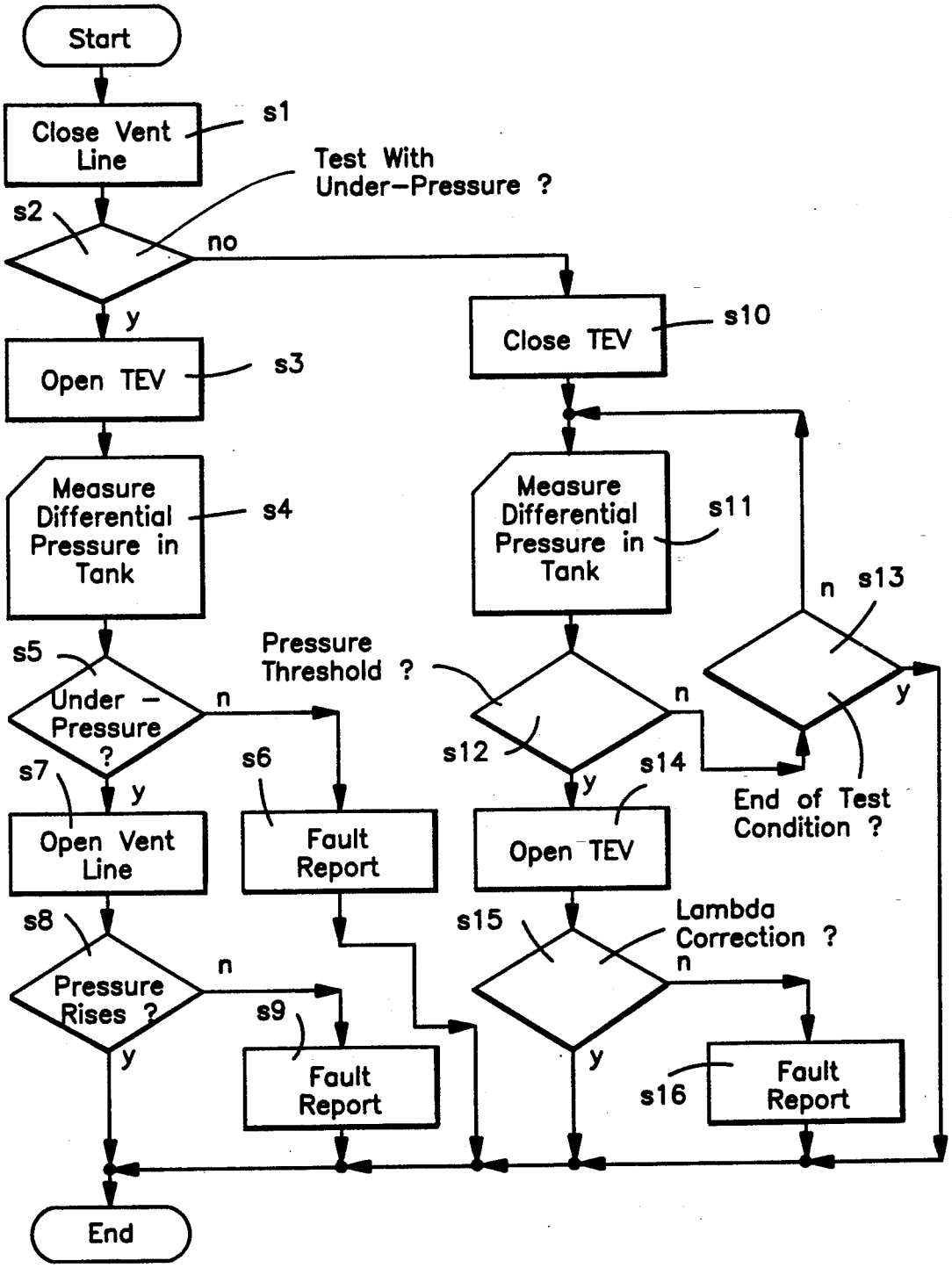

With reference to FIG. 3 it is explained by way of example how the operability of the tank-venting system according to FIG. 1 can be checked. The method also permits faults to be located in an adsorption filter AF.2 according to FIG. 2, that is having check valves.

After the start of the method according to FIG. 3, the venting line BL is shut off in a step sl, which takes place by means of corresponding actuation of the shut-off valve AV. This method step of shutting off the venting valve is a decisive step for all the method variants explained below.

In a step s2, an inquiry is made as to whether a check with underpressure in the step s3 to s9 is to be carried out. Such a check can occur, for example, at fixed time intervals. If no check is to occur with underpressure, method steps s10 to s16, which utilize overpressure in the system, follow step s2. The checking using overpressure can also occur at fixed time intervals or subsequent to checking with underpressure.

According to step s3, the tank-venting valve TEV is opened. Since the venting line BL is closed, underpressure must now build up in the tank-venting system insofar as the latter is tight. In order to determine this, the pressure measured by the differential pressure sensor DDM is first interrogated in a step s4. If it becomes clear in a step s5 that no underpressure with an absolute value above a predetermined threshold value (for example 50 hPa underpressure) is obtained, a fault report is issued in a step s6. In certain operating states an evaluation can be included, for example full load, since then almost atmospheric pressure is present in the intake pipe and thus no substantial underpressure can build up in the tank-venting system.

After the fault report is issued in step s6, the end of the method is reached. Otherwise, a step s7 follows in which the venting line is cleared again by opening the shut-off valve AV. In a step s8, a check is made as to whether the value of the underpressure measured by the differential pressure sensor DDM is falling. If this is the case, the end of the method is reached. Otherwise, in a step s9, a fault report is issued which indicates that the shut-off valve AV is no longer opening correctly. A leakage and thus incorrect function of the system can thus be completely checked by means of the steps sl to s9.

If in step s2, after the described checking with underpressure has occurred, a switchover occurs to the lambda correction check with overpressure, the tank-venting valve is closed in a step s10 and the venting line BL is blocked by closing the shut-off valve AV. In a step s11, the differential pressure sensor DDM is interrogated. Subsequently, a check is made (step s12) as to whether an overpressure is present which lies above a predetermined threshold, for example at more than 30 hPa. If this is not the case, the steps s11 and s12 are subsequently repeated until an overpressure above the above-mentioned threshold is achieved or until it is determined in a step s13 between the steps s12 and s11 that an end of check condition has occurred. Here, it can, for example, be the expiration of a time interval since the start of the checking of whether the predetermined overpressure is reached. The check end condition can however also occur when predetermined operating states are achieved. If the check end condition occurs, the end of the method is reached directly. Since under certain circumstances, (for example with evaporated fuel) an overpressure never builds up, it may be the case that the pressure threshold is never reached. The following check steps therefore only supply additional information on the underpressure checking and are not sufficient as a fault criterion in themselves.

As soon as step s12 indicates that the predetermined overpressure has been exceeded, the tank-venting valve TEV is opened in a step s14. As a result, the internal combustion engine is suddenly supplied with fuel in addition to that which is injected in any case. The lambda control must then reduce the quantity of fuel to be injected. In a step s15, it is checked whether a leanness correction is required in the lambda control with the opening of the tank-venting valve in step s14. If this is the case, it is confirmed once more that the tank-venting system has supplied fuel in the expected manner. The end of the method is then reached. Otherwise, a fault report is issued in a step s16. If the preceding underpressure check already indicated a fault, it is now proven that there is a break in the connection line intake pipe - tank-venting valve.

If the tank-venting valve TEV is opened in step s14, an underpressure builds up in the tank-venting system. The realizable underpressure is usually sufficient to cause fuel in the fuel tank KT to evaporate and thus to supply fuel through the valve line VL into the intake pipe SR. However, it is to be ensured that the underpressure is not allowed to fall lower than some 10 hPa since otherwise there is a risk of implosion for the fuel tank KT. The underpressure is correspondingly limited by the protective valve arrangement SVA. In order, nevertheless, to ensure that fuel vapor has to be available in any case for the lambda correction checking in an operative tank-venting system, the check is only carried out if overpressure was previously present in the tank. However, as already mentioned above, this overpressure cannot be guaranteed in all cases despite a blocked venting line BL.

The above-mentioned method sequences at the same time check the operability of an adsorption filter AF.2 having check valves TSV, TBV and FSV according to FIG. 2. If it becomes apparent in step s5 that the expected underpressure is building up, this is an indication that the valves TSV and FSV are clear. If the expected underpressure does not develop, either one of these two valves is blocked or the tank-venting valve TEV or the system has a leak. If the pressure in the tank KT rises above an admissible value when the venting line BL is opened, the check valve TSV is blocked. If the pressure in the tank drops when the venting line BL is opened, this indicates that the tank-venting valve TBV is blocked. In a corresponding manner, a function check of the protective valve arrangement SVA is also possible; no underpressures or overpressures whose absolute values exceed the values of the protective pressures may occur.

In conclusion, it should be noted once more that it is of essential significance for the described tank-venting system that it has a shut-off venting line, and that methods for checking the operability of the system are possible using this shut-off venting line, which methods operate in particular with underpressure, and possibly additionally with overpressure in the system. It is significant that sufficiently high pressures are established on both sides and, above all, that it can be controlled whether overpressure or underpressure is to prevail. Although it is also possible for overpressure or underpressure to prevail in a fuel tank KT in a tank-venting system having an adsorption filter AF.2 according to FIG. 2 having check valves and without shut-off valve AV, the pressures cannot be set reliably. If the check is only based on checking the leanness correction of the lambda control at overpressure, it is, for example, not certain whether the overpressure does not build up because of a leak or whether there is evaporated fuel in the tank.

We claim:

1. A tank-venting arrangement for a motor vehicle having an internal combustion engine equipped with an intake pipe, the arrangement comprising:
   - a fuel tank;
   - an adsorption filter;
   - a filter line connecting said fuel tank to said adsorption filter;
   - a venting line connected to said adsorption filter;
   - a controllable shut-off valve arranged in said venting line;
   - a valve line connecting said adsorption filter to said intake pipe;
   - a tank-venting valve mounted in said valve line for closing and opening said valve line to said intake pipe;
   - control means for closing said shut-off valve and for opening said tank-venting valve; and,
   - measuring means for measuring whether underpressure builds up in said tank when said shut-off valve is closed and said tank-venting valve is opened thereby enabling a conclusion to be made that said arrangement is operative.

2. The tank-venting system of claim 1, wherein the shut-off valve is equipped with overpressure and underpressure protective valves.

3. A method for checking the operability of a motor vehicle tank-venting system having an adsorption filter with venting line, which connects a fuel tank to the intake pipe of an internal combustion engine via a tank-venting valve, the method comprising the steps of:
   - shutting off the venting line of the adsorption filter;
   - opening the tank-venting valve; and,
   - measuring whether underpressure is building up in the tank and, if this is the case, reaching the conclusion that the system is operative.

4. The method of claim 3, further comprising: when underpressure is present, again opening the venting line and whenever the underpressure decays, reaching the conclusion that the shut-off valve for the venting line is operating correctly.

5. The method of claim 3, further comprising the steps of:
   - shutting off the venting line of the adsorption filter;
   - keeping the tank-venting valve closed until a minimum overpressure has built up in the tank and the internal combustion engine is operating at low rates of airflow; and,
   - making a check as to whether a lambda controller has to carry out a correction in the direction of leanness when the tank-venting valve is opened and, if this is the case, reaching the conclusion that the system is operative.

* * * * *